US012203043B2

(12) United States Patent
Suzuki

(10) Patent No.: US 12,203,043 B2
(45) Date of Patent: Jan. 21, 2025

(54) LUBRICATING OIL COMPOSITION

(71) Applicant: SHELL USA, INC., Houston, TX (US)

(72) Inventor: Kengo Suzuki, Kanagawa (JP)

(73) Assignee: Shell USA, Inc., Houston, TX (US)

( * ) Notice: Subject to any disclaimer, the term of this patent is extended or adjusted under 35 U.S.C. 154(b) by 0 days.

(21) Appl. No.: 18/546,619

(22) PCT Filed: Mar. 16, 2022

(86) PCT No.: PCT/EP2022/056767
§ 371 (c)(1),
(2) Date: Aug. 16, 2023

(87) PCT Pub. No.: WO2022/200137
PCT Pub. Date: Sep. 29, 2022

(65) Prior Publication Data

US 2024/0132797 A1 Apr. 25, 2024
US 2024/0228901 A9 Jul. 11, 2024

(30) Foreign Application Priority Data

Mar. 23, 2021 (JP) ..... 2021-049026

(51) Int. Cl.

| | |
|---|---|
| ***C10M 111/04*** | (2006.01) |
| ***C10M 101/02*** | (2006.01) |
| ***C10M 107/02*** | (2006.01) |
| ***C10M 111/02*** | (2006.01) |
| *C10N 20/02* | (2006.01) |
| *C10N 30/00* | (2006.01) |
| *C10N 30/02* | (2006.01) |
| *C10N 30/12* | (2006.01) |
| *C10N 40/04* | (2006.01) |

(52) U.S. Cl.
CPC ..... *C10M 111/04* (2013.01); *C10M 101/02* (2013.01); *C10M 107/02* (2013.01); *C10M 111/02* (2013.01); *C10M 2203/1006* (2013.01); *C10M 2203/1025* (2013.01); *C10M 2205/173* (2013.01); *C10N 2020/02* (2013.01); *C10N 2030/02* (2013.01); *C10N 2030/12* (2013.01); *C10N 2030/40* (2020.05); *C10N 2040/04* (2013.01)

(58) Field of Classification Search
CPC ..... C10M 111/04; C10M 101/02; C10M 107/02; C10M 111/02; C10M 2203/1006; C10M 2203/1025; C10M 2205/173; C10M 2205/0285; C10N 2020/02; C10N 2030/02; C10N 2030/12; C10N 2030/40; C10N 2040/04; C10N 2020/01; C10N 2020/067; C10N 2030/08; C10N 2040/14
See application file for complete search history.

(56) References Cited

U.S. PATENT DOCUMENTS

| | | | | |
|---|---|---|---|---|
| 3,839,189 | A * | 10/1974 | Mills | C10M 1/08 208/18 |
| 10,100,265 | B2 | 10/2018 | Hanyuda et al. | |
| 2008/0015400 | A1 | 1/2008 | Matsui et al. | |
| 2015/0203779 | A1* | 7/2015 | Hanyuda | F02B 43/02 508/501 |
| 2019/0382682 | A1 | 12/2019 | Kobayashi et al. | |

FOREIGN PATENT DOCUMENTS

| | | | | |
|---|---|---|---|---|
| WO | WO-2014184362 | A1 * | 11/2014 | C10M 129/76 |

OTHER PUBLICATIONS

US 4,800,029 A, 01/1989, Dasai (withdrawn)
International Search Report and Written Opinion Received for PCT Patent Application No. PCT/EP2022/056767, Mailed on Jul. 15, 2022, 11 Pages.

* cited by examiner

*Primary Examiner* — Cephia D Toomer
(74) *Attorney, Agent, or Firm* — Shell USA, Inc.

(57) ABSTRACT

The present invention provides a lubricating oil composition used in the reduction gearbox or transmission of an electric vehicle or a hybrid vehicle, wherein the lubricating oil contains a base oil, and the aromatic ring content of the base oil is from 3,500 to 15,000 ppm in terms of the mass of the base oil.

3 Claims, No Drawings

LUBRICATING OIL COMPOSITION

CROSS REFERENCE TO RELATED APPLICATIONS

This is a National stage application of International Application No. PCT/EP2022/056767, filed 16 Mar. 2022, which claims priority of Japan Application No. 2021-049026, filed 23 Mar. 2021 which is incorporated herein by reference in its entirety.

FIELD OF THE INVENTION

The present invention relates to a lubricating oil composition for use in the reduction gearbox or transmission of an electric vehicle or a hybrid vehicle.

BACKGROUND OF THE INVENTION

In order to protect the environment, electric vehicles and hybrid vehicles, which place less of a burden on the environment when operating, have become increasingly popular. These newly popular electric vehicles operate by combining an electric motor with a reduction gearbox or a transmission that increases the driving force of the electric motor. The newly popular hybrid vehicles combine an engine with a motor.

A lubricating oil has to be used in reducing gearboxes and transmissions to transmit the driving force more smoothly, but copper is a material commonly found in the coils and wiring of an electric motor. Therefore, the copper corrosiveness of lubricating oils used in the reduction gearboxes of electric vehicles or hybrid vehicles has to be reduced. In particular, lubricating oil compositions typically contain compounds such as sulfur-based compounds that cause copper to corrode.

A lubricating oil composition with low copper corrosiveness was proposed in JP2018119059 A that contains a base oil, a specific sulfur-containing compound, and a specific thiadiazole compound.

Electric motors have a higher rotation speed than the engines used as the power plant in a conventional automobile, and the stirring resistance of the lubricating oil used in the transmission has a significant impact on energy consumption. Therefore, from the standpoint of fuel economy, the lubricating oil used in electric vehicles must have a low viscosity and low temperature fluidity. Also, the heat generated by the sliding parts of a reduction gearbox is applied to the reduction gearbox in an electric vehicle or hybrid vehicle, and the lubricating oil is also responsible for absorbing and cooling the heat generated by the motor. Therefore, even higher oil temperatures can be expected.

The lubricating oil composition in JP2018119059 A takes copper corrosiveness into account but not the flash point and low temperature fluidity, and it does not meet the performance requirements of a lubricating oil composition suitable for use in the reduction gearbox or transmission of an electric vehicle or a hybrid vehicle.

Therefore, it is an object of the present invention to provide a lubricating oil composition suitable for use in the reduction gearbox or transmission of an electric vehicle or a hybrid vehicle that is able to reduce copper corrosion, improve the flash point, and improve low temperature fluidity.

After conducting extensive research, the present inventors discovered that this object could be achieved when the base oil satisfied certain properties.

SUMMARY OF THE INVENTION

The present invention is a lubricating oil composition used in the reduction gearbox or transmission of an electric vehicle or a hybrid vehicle, wherein the lubricating oil contains a base oil, and the aromatic ring content of the base oil is from 3,500 to 15,000 ppm in terms of the mass of the base oil. Preferably, the base oil contains a first base oil that is a Group 1 base oil and a second base oil that is a GTL base oil and/or PAO, the first base oil content being from 8 to 25% by mass in terms of the total mass of the lubricating oil composition, and the second base oil content being from 60 to 90% by mass in terms of the total mass of the lubricating oil composition. The amount of eluted copper in the lubricating oil composition as measured in accordance with JIS K 2513 is preferably less than 10 ppm. The pour point of the lubricating oil composition as measured in accordance with JIS K 2269 is preferably lower than −40° C. The flash point of the lubricating oil composition as measured in accordance with JIS K 2265-4 is preferably higher than 208° C.

DETAILED DESCRIPTION OF THE INVENTION

The present invention is able to provide a lubricating oil composition suitable for use in the reduction gearbox or transmission of an electric vehicle or a hybrid vehicle that can reduce copper corrosion, improve the flash point, and improve low temperature fluidity.

The following is a description of the components, physical characteristics and properties, production method, and applications for a lubricating oil composition of the present invention.

The lubricating oil composition contains a base oil and other components that can be added depending on the desired properties.

The aromatic ring content of the base oil is from 3,500 to 15,000 ppm, preferably from 4,000 to 14,000 ppm, and more preferably from 5,000 to 13,000 ppm, in terms of the mass of the base oil. The aromatic ring content can be measured based on ASTM D3238.

When the base oil has this property, copper corrosion can be reduced, the flash point can be improved, and low temperature fluidity can be improved.

There are no particular restrictions on the base oil that is used as long as it satisfies this property. Examples include mineral oils, synthetic oils, animal and plant oils, and combinations of these. Specific examples include base oils belonging to Group 1, Group 2, Group 3, and Group 4 of the API (American Petroleum Institute) base oil categories, which can be used alone or in a mixture.

Group 1 base oils include paraffinic mineral oils obtained by an appropriate combination of refining methods such as solvent refining, hydrorefining, and dewaxing performed on lubricating oil fractions obtained from atmospheric distillation of crude oil.

Group 2 base oils include paraffinic mineral oils obtained by an appropriate combination of refining methods such as hydrorefining and dewaxing performed on lubricating oil fractions obtained from atmospheric distillation of crude oil. Group 2 base oils refined using, for example, the Gulf Oil hydrorefining method have a total sulfur content of less than 10 ppm and an aromatic content of 5% or less. Use of these base oils is preferred.

Group 3 base oils and Group 2 class base oils include paraffinic mineral oils produced by a high degree of hydrorefining performed on lubricating oil fractions obtained from the atmospheric distillation of crude oil, base oils refined using the Isodewax process which dewaxes and substitutes the wax produced by the dewaxing process with isoparaffins, and base oils refined using the Mobil Oil wax isomerization process. Use of these base oils is also preferred.

Examples of synthetic oils include polyolefins, dibasic acid diesters, trimellitic acid triesters, polyol esters, alkylbenzenes, alkylnaphthalenes, polyoxyalkylene glycols, polyoxyalkylene glycol esters, polyoxyalkylene glycol ethers, polyphenyl ether, dialkyldiphenyl ethers, fluorine-containing compounds (perfluoropolyether, fluorinated polyolefins, etc.), and silicone. The polyolefins includes polymers of various olefins or hydrides of these. Any polyolefin can be used, and examples include ethylene, propylene, butene, and α-olefins with five or more carbon atoms. In the production of a polyolefin, one type of olefin or a combination of two or more types can be used. Especially preferred are the polyolefins known as poly-α-olefins (PAOs), which are Group 4 base oils.

Gas-to-liquid oils (GTL base oils) synthesized using the Fischer-Tropsch method of converting natural gas to liquid fuel have a very low sulfur content and aromatic content as well as a very high paraffin ratio compared to mineral-oil base oils refined from crude oil. As a result, they have excellent oxidative stability and experience extremely low evaporation loss. Use of these base oils is also preferred.

The base oil preferably contains a first base oil that is a Group 1 base oil and a second base oil that is a GTL base oil and/or PAO. The first base oil content is preferably from 8 to 25% by mass and the second base oil content (GTL base oil and PAO total content) is preferably from 60 to 90% by mass in terms of the total mass of the lubricating oil composition. When these base oils are used, it is easier to adjust the aromatic ring content of the lubricating oil composition and the effects of the present invention can be increased.

These other compounds are commonly used additives such as metal-based detergents, anti-wear agents, dispersants, defoamers, pour point depressants, metal deactivators, antioxidants, and viscosity index improvers.

There are no particular restrictions on the amount of other components used in the lubricating oil composition, but in terms of the total mass of the lubricating oil composition, the amount can be 1% by mass or more, 2% by mass or more, 3% by mass or more, or 5% by mass or more, and 30% by mass or less, 20% by mass or less, 15% by mass or less, or 10% by mass or less.

In order to increase the effects of the present invention, the aromatic ring content of the other components is preferably 500 ppm or less, 100 ppm or less, 10 ppm or less, or 1 ppm or less in terms of the total amount of lubricating oil composition.

The amount of eluted copper in the lubricating oil composition as measured in accordance with JIS K 2513 (150° C., 48 hours) is preferably less than 10 ppm, more preferably 8 ppm or less, and even more preferably 6 ppm or less. When the amount of eluted copper is within this range, the lubricating oil composition is especially suitable for use in the reduction gearbox or transmission of an electric vehicle or a hybrid vehicle. The amount of eluted copper can be measured using inductively coupled plasma (ICP) emission spectroscopy.

The pour point of the lubricating oil composition as measured in accordance with JIS K 2269 is preferably lower than −40° C., more preferably −45° C. or lower, and even more preferably −50° C. or lower. When the pour point is within this range, the lubricating oil composition is especially suitable for use in the reduction gearbox or transmission of an electric vehicle or a hybrid vehicle.

The flash point of the lubricating oil composition as measured in accordance with JIS K 2265-4 is preferably higher than 208° C. and more preferably 210° C. or higher. When the flash point is within this range, the lubricating oil composition is especially suitable for use in the reduction gearbox or transmission of an electric vehicle or a hybrid vehicle.

The kinematic viscosity at 40° C. of the lubricating oil composition as measured in accordance with JIS K 2283 is preferably from 5 to 100 $mm^2/s$, more preferably from 10 to 80 $mm^2/s$, and even more preferably from 15 to 50 $mm^2/s$.

The kinematic viscosity at 100° C. of the lubricating oil composition as measured in accordance with JIS K 2283 is preferably from 1 to 30 $mm^2/s$, more preferably from 2 to 20 $mm^2/s$, and even more preferably from 3 to 10 $mm^2/s$.

The viscosity index (VI) of the lubricating oil composition is preferably 50 or higher, more preferably 100 or higher, and even more preferably 125 or higher.

The lubricating oil composition can be produced using any method common in the art. The components may be mixed together as appropriate, and there are no particular restrictions on the order in which the components are mixed together. The additives may be added in the form of an additive package containing a mixture of different additives.

A lubricating oil composition of the present invention is used in the reduction gearbox or transmission of an electric vehicle or a hybrid vehicle.

EXAMPLES

The following ingredients were mixed together in the amounts (% by mass) shown in the tables to produce the lubricating oil compositions in the examples and comparative examples.

Base Oil A-1—A mineral oil classified in Group II of the API base oil categories with a kinematic viscosity at 40° C. of 12.4 $m^2/s$ and a kinematic viscosity at 100° C. of 3.1 $mm^2/s$ Base Oil A-2—A mineral oil classified in Group III of the API base oil categories with a kinematic viscosity at 40° C. of 19.6 $m^2/s$ and a kinematic viscosity at 100° C. of 4.2 $mm^2/s$ Base Oil A-3—A mineral oil classified in Group III of the API base oil categories with a kinematic viscosity at 40° C. of 47.2 $m^2/s$ and a kinematic viscosity at 100° C. of 7.7 $mm^2/s$ Base Oil B-1—A Fischer-Tropsch-derived base oil (GTL) with a kinematic viscosity at 40° C. of 9.9 $m^2/s$ and a kinematic viscosity at 100° C. of 2.7 $mm^2/s$ Base Oil B-2—A Fischer-Tropsch-derived base oil (GTL) with a kinematic viscosity at 40° C. of 18.2 $m^2/s$ and a kinematic viscosity at 100° C. of 4.1 $mm^2/s$ Base Oil B-3—A Fischer-Tropsch-derived base oil (GTL) with a kinematic viscosity at 40° C. of 43.7 $m^2/s$ and a kinematic viscosity at 100° C. of 7.6 $mm^2/s$ Base Oil C-1—A polyalphaolefin base oil (PAO) with a kinematic viscosity at 40° C. of 18.6 $m^2/s$ and a kinematic viscosity at 100° C. of 4.1 $mm^2/s$ Base Oil C-2—A polyalphaolefin base oil (PAO) with a kinematic viscosity at 40° C. of 48.0 $m^2/s$ and a kinematic viscosity at 100° C. of 8.0 $mm^2/s$ Base Oil D-1—A mineral oil classified in Group I of the API base oil categories with a kinematic viscosity at 40° C. of 53.1 $m^2/s$ and a kinematic viscosity at 100° C. of 7.6 $mm^2/s$ Base Oil D-2—A mineral oil classified in Group I of the API base oil categories with a kinematic viscosity at 40° C. of 96.1 $m^2/s$ and a kinematic viscosity at 100° C. of 11.2 $mm^2/s$ Base Oil D-3—A mineral oil classified in Group I of the API base oil categories with a kinematic viscosity at 40° C. of 492.3 $m^2/s$ and a kinematic viscosity at 100° C. of 32.7 $mm^2/s$ Pour Point Depressant—A polymethacrylate pour point depressant with a peak crystallization temperature of −29° C.

Additive Package—An additive package for reduction gearbox and transmission oils for an electric vehicle or a hybrid vehicle with an added electric motor cooling application The kinematic viscosity at 40° C., the kinematic viscosity at 100° C., the viscosity index, the pour point, the flash point, and the amount of eluted copper were measured for each lubricating oil composition using the methods described above. The measurement results are shown in the tables below.

TABLE 1

| Base Oil Group | Base Oil | 40° C. Visc. | 100° C. Visc. | Visc. Ind. | Pour Pt. | % Ca | Ex. 1 | Ex. 2 | Ex. 3 | Ex. 4 | Ex. 5 | Ex. 6 | Ex. 7 |
|---|---|---|---|---|---|---|---|---|---|---|---|---|---|
| Gp. II | A-1) Min. Oil | 12.4 | 3.1 | 112 | −24.0 | 0.0 | | | | | | | |
| Gp. III | A-2) Min. Oil | 19.6 | 4.2 | 122 | −15.0 | 0.0 | | | | | | | |
| Gp. III | A-3) Min. Oil | 47.2 | 7.7 | 130 | −15.0 | 0.0 | | | | | | | |
| Gp. II | B-1) GTL | 9.9 | 2.7 | 116 | −45.0 | 0.0 | | | 31.4 | 13.5 | 27.0 | | |
| Gp. III | B-2) GTL | 18.2 | 4.1 | 129 | −42.5 | 0.0 | 69.8 | 76.9 | 38 | 65.7 | 47.9 | 83.4 | |
| Gp. III | B-3) GTL | 43.7 | 7.6 | 141 | −40.0 | 0.0 | | | | | | | |
| Gp. IV | C-1) PAO | 18.6 | 4.1 | 126 | <−52.5 | 0.0 | | | | | | | 83.4 |
| Gp. IV | C-2) PAO | 48.0 | 8.0 | 139 | <−52.5 | 0.0 | | | | | | | |
| Gp. I | D-1) Min. Oil | 53.1 | 7.6 | 107 | −12.5 | 3.5 | 22.1 | | | | | | |
| Gp. I | D-2) Min. Oil | 96.1 | 11.2 | 102 | −10.0 | 3.7 | | 15 | 22.5 | | | | |
| Gp. I | D-3) Min. Oil | 492.3 | 32.7 | 98 | −12.5 | 7.2 | | | | 12.8 | 17 | 8.5 | 8.5 |
| Pour Point Depressant | | — | — | — | — | — | 8.0 | 8.0 | 8.0 | 8.0 | 8.0 | 8.0 | 8.0 |
| Additive Package | | — | — | — | — | — | 0.1 | 0.1 | 0.1 | 0.1 | 0.1 | 0.1 | 0.1 |
| Aromatic Ring Content of Base Oil | | | | | ppm | | 7700 | 5500 | 8200 | 9200 | 12000 | 6100 | 6100 |
| Kin. Visc. | JIS K 2283 | | 40° C. | | $mm/s^2$ | | 25.2 | 25.4 | 22.4 | 25.5 | 25.7 | 25.4 | 25.5 |
| | | | 100° C. | | $mm/s^2$ | | 5.1 | 5.1 | 4.7 | 5.2 | 5.2 | 5.2 | 5.2 |
| Visc. Index | JIS K 2283 | | | | — | | 133 | 135 | 132 | 138 | 138 | 137 | 138 |
| Pour Pt. | JIS K 2269 | | | | ° C. | | −47.5 | −50.0 | −50.0 | <−52.5 | <−52.5 | <−52.5 | <−52.5 |
| Flash Pt. | JIS K 2265-4 | | COC Method | | ° C. | | 226 | 226 | 210 | 216 | 214 | 220 | 220 |
| Cu Corrosion Test | JIS K 2513 (Rev.) (150° C. × 48 h) | | Amt. of Eluted Cu | | ppm | | 3 | 5 | 3 | 4 | 3 | 5 | 4 |

| Base Oil Group | Base Oil | 40° C. Visc. | 100° C. Visc. | Visc. Ind. | Pour Pt. | % Ca | C. Ex. 1 | C. Ex. 2 | C. Ex. 3 | C. Ex. 4 | C. Ex. 5 | C. Ex. 6 | C. Ex. 7 | C. Ex. 8 |
|---|---|---|---|---|---|---|---|---|---|---|---|---|---|---|
| Gp. II | A-1) Min. Oil | 12.4 | 3.1 | 112 | −24.0 | 0.0 | | | | | | | 67.9 | |
| Gp. III | A-2) Min. Oil | 19.6 | 4.2 | 122 | −15.0 | 0.0 | | | 69.8 | | | | | |
| Gp. III | A-3) Min. Oil | 47.2 | 7.7 | 130 | −15.0 | 0.0 | | | 22.1 | | | | | |
| Gp. II | B-1) GTL | 9.9 | 2.7 | 116 | −45.0 | 0.0 | | 37.9 | | | | | | 62.9 |
| Gp. III | B-2) GTL | 18.2 | 4.1 | 129 | −42.5 | 0.0 | 69.8 | | | | 73.4 | 76.6 | | |
| Gp. III | B-3) GTL | 43.7 | 7.6 | 141 | −40.0 | 0.0 | 22.1 | 54 | | | 11.1 | 11.1 | | |
| Gp. IV | C-1) PAC | 18.6 | 4.1 | 126 | <−52.5 | 0.0 | | | | 69.8 | | | | |
| Gp. IV | C-2) PAO | 48.0 | 8.0 | 139 | <−52.5 | 0.0 | | | | 22.1 | | | | |
| Gp. I | D-1) Min. Oil | 53.1 | 7.6 | 107 | −12.5 | 3.5 | | | | | | | | |
| Gp. I | D-2) Min. Oil | 96.1 | 11.2 | 102 | −10.0 | 3.7 | | | | | 7.5 | | | |
| Gp. I | D-3) Min. Oil | 492.3 | 32.7 | 98 | −12.5 | 7.2 | | | | | | 4.3 | 24.0 | 29.0 |
| Pour Point Depressant | | — | — | — | — | — | 8.0 | 8.0 | 8.0 | 8.0 | 8.0 | 8.0 | 8.0 | 8.0 |
| Additive Package | | — | — | — | — | — | 0.1 | 0.1 | 0.1 | 0.1 | 0.1 | 0.1 | 0.1 | 0.1 |
| Aromatic Ring Content of Base Oil | | | | | ppm | | 0 | 0 | 0 | 0 | 2700 | 3100 | 17000 | 21000 |
| Kin. Visc. | JIS K 2283 | | 40° C. | | $mm/s^2$ | | 25.0 | 25.0 | 25.9 | 25.2 | 25.2 | 25.2 | 29.1 | 26.7 |
| | | | 100° C. | | $mm/s^2$ | | 5.2 | 5.2 | 5.2 | 5.2 | 5.1 | 5.2 | 5.5 | 5.4 |
| Visc. Index | JIS K 2283 | | | | — | | 141 | 146 | 137 | 141 | 137 | 139 | 131 | 139 |
| Pour Pt. | JIS K 2269 | | | | ° C. | | <−52.5 | −50.0 | −40.0 | <−52.5 | <−52.5 | <−52.5 | −52.5 | <−52.5 |
| Flash Pt. | JIS K 2265-4 | | COC Method | | ° C. | | 222 | 212 | 222 | 222 | 226 | 220 | 206 | 198 |
| Cu Corrosion Test | JIS K 2513 (Rev. ) (150° C. × 48 h) | | Amt. of Eluted Cu | | ppm | | 18 | 14 | 15 | 13 | 10 | 10 | 3 | 3 |

I claim:

1. A lubricating oil composition used in the reduction gearbox or transmission of an electric vehicle or a hybrid vehicle, wherein the lubricating oil contains a base oil, and the aromatic ring content of the base oil measured according to ASTM D3238 is from 3,500 to 15,000 ppm in terms of the mass of the base oil, wherein the base oil contains a first base oil that is a Group 1 base oil and a second base oil that is a gas-to-liquids (GTL) base oil and/or poly-α-olefin (PAO), the first base oil content being from 8 to 25% by mass in terms of the total mass of the lubricating oil composition, and the second base oil content being from 60 to 90% by mass in terms of the total mass of the lubricating oil composition, and wherein the pour point of the lubricating oil composition as measured in accordance with JIS K 2269 is lower than −40° C.

2. A lubricating oil composition according to claim 1, wherein the amount of eluted copper as measured in accordance with JIS K 2513 (150° C., 48 hours) is less than 10 ppm.

3. A lubricating oil composition according to claim 1, wherein the flash point as measured in accordance with JIS K 2265-4 is higher than 208° C.

* * * * *